United States Patent [19]

Davis

[11] 3,940,939

[45] Mar. 2, 1976

[54] VAPOR CYCLE ENGINE HAVING A TRIFLUOROETHANOL AND AMMONIA WORKING FLUID

[75] Inventor: Jerry P. Davis, Concord, Mass.

[73] Assignee: Thermo Electron Corporation, Waltham, Mass.

[22] Filed: Apr. 14, 1975

[21] Appl. No.: 567,799

[52] U.S. Cl. ..... 60/657; 60/671; 252/68

[51] Int. Cl.[2] ..... F01K 25/06

[58] Field of Search ..... 60/651, 671, 657; 252/68

[56] References Cited

UNITED STATES PATENTS 3,584,457 6/1971 Davoud ..... 60/649

3,834,166 10/1974 Cupper et al. ..... 60/651

*Primary Examiner*—Allen M. Ostrager

*Attorney, Agent, or Firm*—James L. Neal

[57] ABSTRACT

A closed vapor cycle engine which uses a trifluoroethanol working fluid improved by the addition of ammonia for corrosion protection. The working fluid may contain water. The improvement improves life and reduces maintenance of the engine.

14 Claims, 1 Drawing Figure

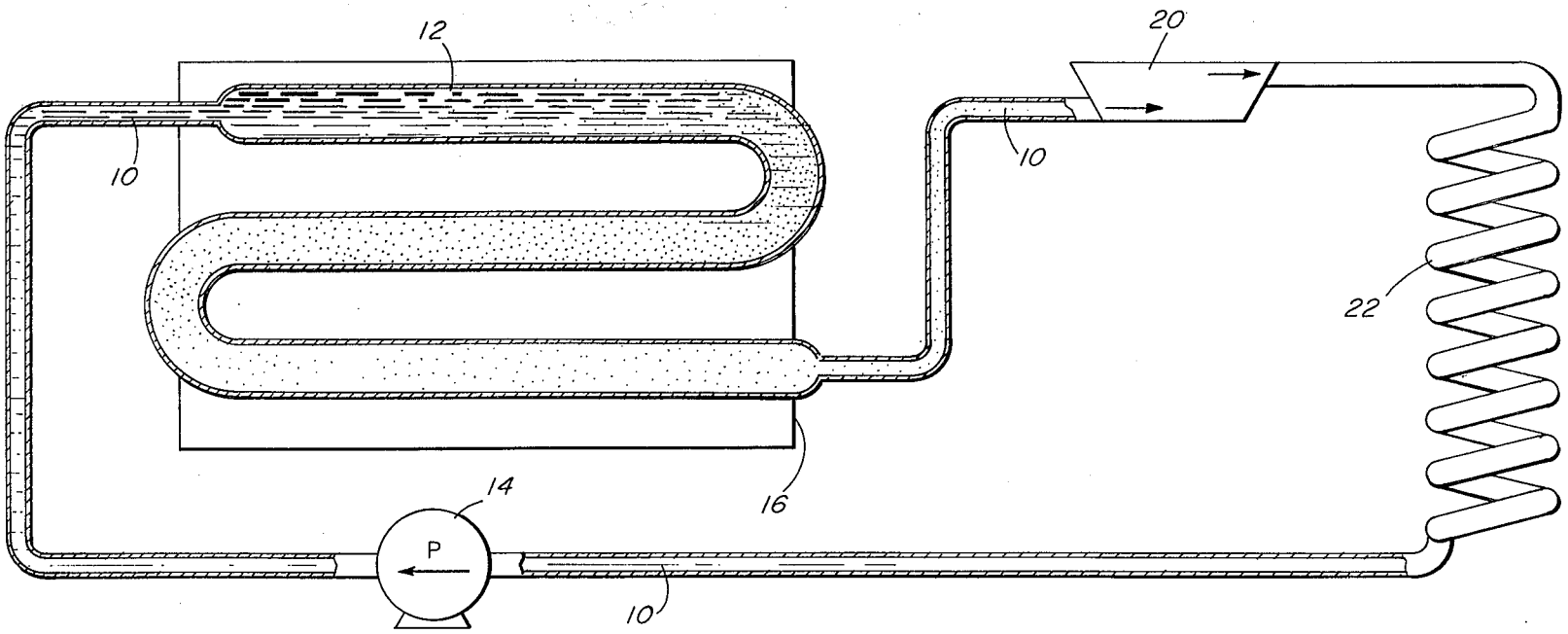
22
20
10
16
10
14
P
12
10

VAPOR CYCLE ENGINE HAVING A TRIFLUOROETHANOL AND AMMONIA WORKING FLUID

BACKGROUND OF INVENTION

The closed vapor cycle engine offers advantages over a conventional internal combustion engine, particularly in regard to fuel conservation and atmospheric pollution. Vapor cycle engines serve well as bottoming cycle engines, such as one which utilizes the otherwise waste heat of an internal combustion engine. Also, they offer possible replacements for gasoline and deisel engines.

Trifluoroethanol ($CF_3CH_2OH$) and trifluroethanol/water working fluids are thermodynamically well suited for vapor cycle engines. These working fluids are less corrosive to iron alloys than water, and generally are not likely to cause early corrosion failure of engine parts. However, they are corrosive enough to be contaminated by corrosion products when in contact with carbon steel, cast iron and other iron alloy engine parts. These corrosion products are removed by filtration.

BRIEF SUMMARY OF THE INVENTION

The present invention relates to closed vapor cycle engines, using a trifluoroethanol working fluid including an additive of ammonia or ammonium hydroxide for corrosion inhibition. Ammonium hydroxide or anhydrous ammonia may be used. The presence of ammonia substantially inhibits corrosion and thereby extends the life of the engine and reduces maintenance.

BRIEF DESCRIPTION OF THE DRAWINGS

The drawing is a schematic view of closed vapor cycle engine.

DETAILED DESCRIPTION OF THE DRAWING

Referring to the FIGURE which shows a closed vapor cycle engine, working fluid 10 in the liquid state is pumped to a vapor generator 12 by a pump 14, where it is vaporized by heat from a heat source 16. The vapor generator 12 may use heat from a variety of sources. The vapor generated by the vapor generator 12 is introduced to an expander 20 to produce work. Turbine and reciprocating piston expanders are the most common, but other types are known. Typically these have iron alloy parts exposed to the working fluid. Exhausted working fluid vapor is then condensed to liquid in a condenser 22 and finally pumped back to the vapor generator 12.

Typically the vapor generator 12 uses heat given off by a burner or heat rejected by another system. Waste heat from an internal combustion engine may provide the heat input. In such a configuration the vapor cycle engine is commonly referred to as a bottoming cycle. One example of a bottoming cycle system is disclosed in U.S. Pat. No. 3,830,062.

Trifluoroethanol ($CH_3CH_2OH$) and mixtures of trifluoroethanol and water have desirable thermodynamic properties for vapor cycle engines which operate from about 300°F to 650°F, and in the pressure range of 300–1000 psia. These temperatures and pressures are appropriate for engines constructed of low cost materials such as ordinary carbon steel, cast iron and other iron alloys.

Such engines commonly use a once through vapor generator which may be visualized as a tube heated along its length. Liquid working fluid is introduced at one end and is vaporized, and possibly superheated, by the time it reaches the other end. This type of vapor generator is relatively small and inexpensive and working fluid is vaporized essentially on demand so only a small amount of high pressure vapor is in the vapor generator at one time. The small volume of vaporized working fluid is advantageous both as to a short warm up time and as to safety in the event of a large leak or a rupture in the engine.

Nonvaporizable material, including corrosion products, suspended in the working fluid may be deposited in the once through generator, thereby interferring with its action. Only a small amount of such material will impair performance of the engine. Even in a kettle-type vapor generator, solid non-volatile material in the working fluid interferes with the generator by forming deposits on its inside walls. Trifluoroethanol and trifluoroethanol/water working fluids, though only mildly corrosive to carbon steel and cast iron, produce a small amount of corrosion which in time will shorten engine life or increase maintenance costs. Inhibition of corrosion extends engine life and reduces maintenance.

Corrosion inhibition is provided by the addition of ammonia, in the form of pure ammonia ($NH_3$) or as solution of ammonium hydroxide ($NH_4OH$), to trifluroethanol or a trifluoroethanol/water mixture working fluids. Ammonium hydroxide is the probable form of ammonia in a water solution. It is preferred that ammonia or ammonium hydroxide be added so that the concentration of ammonia (as $NH_3$) is not less than one tenth of one percent or more than three percent by weight. Ammonia, being volatile, is not deposited in the vapor generator. It also affords protection throughout the system, being carried along with the working fluid.

The mechanism of trifluroethanol's corrosion of iron alloys is obscure; it has been found that commercially "pure" trifluoroethanol is more corrosive than a trifluroethanol/water mixture containing 15 mole percent of water. Apparently, water is not the major corrosive substance in such trifluoroethanol/water mixtures.

The following table illustrates the effectiveness of ammonia as a corrosion inhibitor in a solution of trifluoroethanol and water. Water is present in a concentration of about 3 percent by weight, corresponding to 15 mole percent. Each example represents a sample of fluid exposed to air and carbon steel and observed after several days, as the table indicates. It can be seen the addition of very small amounts of ammonia significantly reduces contamination of the fluid by corrosion products.

| EXAMPLE | TEMP (°F) | PERCENT $NH_4$ (WEIGHT) | ELAPSED TIME (DAYS) | CONDITION OF FLUID |
|---|---|---|---|---|
| 1 | Room | 0 | 3 | Clear |
| | | | 13 | Particles |
| | | | 21 | Particles |
| 2 | Room | .2 | 3 | Clear |
| | | | 13 | Clear |
| | | | 21 | Clear |
| 3 | Room | .58 | 3 | Clear |
| | | | 13 | Clear |
| | | | 21 | Clear |
| 4 | 600°F | 0 | 3 | Fine particles |
| | | | 11 | Fine particles |
| | | | 22 | Fine particles, deposit on test tube |
| 5 | 600°F | .2 | 3 | Clear yellow |
| | | | 11 | Yellow w/black particles |
| | | | 22 | Yellow w/black |

-continued

| EX-AMPLE | TEMP (°F) | PERCENT $NH_4$ (WEIGHT) | ELAPSED TIME (DAYS) | CONDITION OF FLUID |
|---|---|---|---|---|
| | | | | particles, deposit on test tube |
| 6 | 600°F | .58 | 3 | Clear yellow |
| | | | 11 | Clear yellow |
| | | | 22 | Clear yellow |
| 7 | 600°F | 0 | 15 | Fine particles |
| | | | 25 | Large particles |
| 8 | 600°F | .58 | 15 | Clear yellow, gray coating on test tube |
| | | | 25 | Clear yellow, gray coat on test tube |
| 9 | 600°F | .58 | 15 | Clear yellow, gray on test tube |
| | | | 25 | Clear yellow, gray coat on test tube |

This invention has been described by way of preferred embodiment. It will be apparent that certain modifications and changes may be made without departing from the scope of this invention as set forth by the following claims.

I claim:

1. A closed vapor cycle engine having iron alloy parts comprising:

a trifluoroethanol working fluid wherein said working fluid is in contact with said iron alloy parts of said engine;

vapor generating means for vaporizing said working fluid;

expander means for expanding working fluid vapor to produce work;

condenser means for condensing expanded working fluid vapor to liquid; and pump means to introduce condensed working fluid vapor to said vapor generator;

wherein said working fluid further comprises ammonia in sufficient quantity to inhibit corrosion of said iron alloy parts.

2. The engine of claim 1, wherein said working fluid comprises at least 0.1 percent by weight of ammonia.

3. The engine of claim 2, wherein said working fluid comprises not more than 3 percent by weight of ammonia.

4. The engine of claim 3, wherein said engine uses a once through vapor generator.

5. A closed vapor cycle engine having iron alloy parts comprising:

a trifluoroethanol working fluid containing between 1 and 40 percent by weight of water wherein said working fluid is in contact with iron alloy parts of said engine;

vapor generating means for vaporizing said working fluid;

expander means for expanding working fluid vapor to produce work;

condenser means to condense expanded working fluid vapor to liquid; and pump means to introduce condensed working fluid vapor to said vapor generator;

wherein said working fluid further comprises ammonia for inhibiting corrosion of said iron alloy parts.

6. The engine of claim 5, wherein said working fluid comprises between 1 and 18 percent by weight of water.

7. The engine of claim 6, wherein said working fluid comprises at least 0.1 percent by weight of ammonia.

8. The engine of claim 7, wherein said working fluid comprises not more than 3 percent by weight of ammonia.

9. The engine of claim 6, wherein said working fluid comprises about 3 percent by weight of water.

10. The engine of claim 9, wherein said working fluid comprises at least 0.1 percent ammonia by weight.

11. The engine of claim 10, wherein said working fluid comprises no more than 3 percent of ammonia by weight.

12. The engine of claim 11, wherein said engine uses a once through vapor generator.

13. A closed vapor cycle engine comprising iron alloy parts and working fluid contact with said iron alloy parts, wherein said working fluid comprises about 96.5 percent by weight of trifluoroethanol, 3 percent by weight of water, and 0.5 percent by weight of ammonia.

14. The engine of claim 13, wherein said engine's heat source comprises waste heat from an internal combustion engine.

* * * * *

UNITED STATES PATENT OFFICE
CERTIFICATE OF CORRECTION

Patent No. 3,840,939 Dated October 15, 1974

Inventor(s) NORIO YAMANASHI

It is certified that error appears in the above-identified patent and that said Letters Patent are hereby corrected as shown below:

Column 1, line 37, "reat Z" should read --meat X--;

Column 1, line 39, "X" should read --Z--;

Column 9, line 64, "samll" should read --small--.

Signed and sealed this 24th day of December 1974.

(SEAL)
Attest:

McCOY M. GIBSON JR.
Attesting Officer

C. MARSHALL DANN
Commissioner of Patents

USCOMM-DC 60376-P69
* U.S. GOVERNMENT PRINTING OFFICE : 1969 O—366-334.